US010714819B2

(12) United States Patent
Apostolos et al.

(10) Patent No.: US 10,714,819 B2
(45) Date of Patent: Jul. 14, 2020

(54) AM/FM DIRECTIONAL ANTENNA ARRAY FOR VEHICLE

(71) Applicant: AMI Research & Development, LLC, Windham, NH (US)

(72) Inventors: John T. Apostolos, Lyndeborough, NH (US); William Mouyos, Windham, NH (US)

(73) Assignee: AMI Research & Development, LLC, Merrimack, NH (US)

( * ) Notice: Subject to any disclaimer, the term of this patent is extended or adjusted under 35 U.S.C. 154(b) by 0 days.

(21) Appl. No.: 15/838,465

(22) Filed: Dec. 12, 2017

(65) Prior Publication Data

US 2018/0166775 A1 Jun. 14, 2018

Related U.S. Application Data

(60) Provisional application No. 62/432,988, filed on Dec. 12, 2016.

(51) Int. Cl.

| | |
|---|---|
| ***H01Q 1/32*** | (2006.01) |
| ***H01Q 21/20*** | (2006.01) |
| ***H01Q 5/42*** | (2015.01) |
| ***H01Q 5/385*** | (2015.01) |
| ***H01Q 9/06*** | (2006.01) |
| ***H01Q 9/32*** | (2006.01) |
| ***H01Q 15/02*** | (2006.01) |

(52) U.S. Cl.

CPC ..... *H01Q 1/3291* (2013.01); *H01Q 1/32* (2013.01); *H01Q 5/385* (2015.01); *H01Q 5/42* (2015.01); *H01Q 9/06* (2013.01); *H01Q 9/065* (2013.01); *H01Q 9/32* (2013.01); *H01Q 15/02* (2013.01); *H01Q 21/20* (2013.01); *H01Q 21/205* (2013.01)

(58) Field of Classification Search

CPC ..... H01Q 1/32–3291
USPC ..... 343/711–714
See application file for complete search history.

(56) References Cited

U.S. PATENT DOCUMENTS

| | | | | |
|---|---|---|---|---|
| 4,823,142 | A * | 4/1989 | Ohe | H01Q 1/1271 343/713 |
| 6,201,504 | B1 * | 3/2001 | Aminzadeh | H01Q 1/1271 343/711 |
| 6,498,588 | B1 | 12/2002 | Callaghan | |
| 6,574,460 | B1 | 6/2003 | Lindenmeier et al. | |
| 7,079,079 | B2 * | 7/2006 | Jo | H01Q 1/243 343/700 MS |
| 2005/0195114 | A1 | 9/2005 | Yegin et al. | |

(Continued)

FOREIGN PATENT DOCUMENTS

DE 19535250 B4 7/2006

OTHER PUBLICATIONS

International Search Report and Written Opinion dated Mar. 23, 2018 for Related PCT/US17/65684.

*Primary Examiner* — Dameon E Levi
*Assistant Examiner* — Hasan Z Islam
(74) *Attorney, Agent, or Firm* — David J. Thibodeau, Jr.; VLP Law Group LLP

(57) ABSTRACT

An antenna array for use in a passenger vehicle. Four of the roof support pillars are used as antenna elements. Each of the four pillars is electrically connected or coupled to one end of a corresponding meanderline component. The other end of each meanderline is in turn coupled to a radio receiver, typically through a combining network.

11 Claims, 7 Drawing Sheets

(56) References Cited

U.S. PATENT DOCUMENTS

| | | | | |
|---|---|---|---|---|
| 2005/0264461 | A1* | 12/2005 | Sugimoto | H01Q 1/1271 343/713 |
| 2008/0026705 | A1* | 1/2008 | Asami | H01Q 1/1271 455/99 |
| 2009/0237313 | A1* | 9/2009 | Martinez Ortigosa | H01Q 1/1271 343/713 |
| 2012/0268332 | A1 | 10/2012 | Guan et al. | |
| 2017/0093027 | A1* | 3/2017 | Kondo | H01Q 1/3275 |

* cited by examiner

| Name | Phi | Ang | Mag |
|---|---|---|---|
| m1 | 340.0000 | -20.0000 | 5.3986 |
| m2 | 160.0000 | 160.0000 | -33.5014 |

AM/FM DIRECTIONAL ANTENNA ARRAY FOR VEHICLE

CROSS REFERENCE TO RELATED APPLICATIONS

This patent application claims priority to a U.S. Provisional Patent Application entitled "AM/FM Directional Antenna Array for Vehicle", Ser. No. 62/432,988 filed Dec. 12, 2016, the entire content of which is hereby incorporated by reference.

BACKGROUND

Technical Field

This patent application relates to an antenna assembly for radio communication in vehicles, and in particular to a directional antenna array adapted for use in the Amplitude Modulation and Frequency Modulation (AM/FM) broadcast radio band.

Background Information

Communication devices have been integrated into automobiles since the 1930's. Historically, these were analog radio receivers operating to receive broadcast programming in the AM and FM bands. A simple fixed mast or whip antenna has most often been used. Such monopole antennas have an omnidirectional radiation pattern, which provides a receive signal with approximately the same strength from all directions. A disadvantage of this type of antenna is that it protrudes from the vehicle body as an unsightly vertical metal pole that is prone to damage, vandalism, and rusting. Another disadvantage of the monopole is that it is typically narrowband with a bandwidth of roughly ten percent.

Antennas have been embedded in certain portions of the vehicle. One common approach implements the antenna as a conductive wire trace deposited onto a window. However, window antennas also have drawbacks, such as reduced visibility out of the window, directional sensitivity, and degradation due to sun exposure over time. So-called shark fin antennas have come into use since the late 1990's. These are roof mounted assemblies, approximately 6 inches or so in length, encased in an aerodynamic or other visually pleasing housing. However, shark fins also protrude from the vehicle body; their shortened length sometimes tends to compromise reception.

A directional antenna formed of multiple radiating elements can provide a concentrated signal or beam in a selected direction to increase the antenna gain and directivity. But since vehicle design is often dictated by styling, the presence of numerous protruding antennas is not desirable. Directional antenna arrays often have complex shapes and large size, making them difficult to package in a vehicle.

It is also preferable to conceal the antenna components to protect them from the elements and to preserve vehicle aesthetics. In order to conceal the antenna, it might be considered to be desirable to locate the radiating elements beneath or conformal to the sheet metal body of a vehicle. However, the presence of large expanses of sheet metal is commonly thought to adversely affect the performance of antennas.

SUMMARY

An antenna system for use in a vehicle includes four metallic radiators, extending downward from a metallic roof section of the vehicle. Also included may be four meanderline components, each having a first and second terminal, with the first terminal connected to a corresponding one of the metallic radiators. A combining circuit is also connected to the second terminal of each of the the meanderline components and connected to a radio receiver and/or transmitter.

Phase shifters and/or delay components may be connected between the meanderlines and the combining circuit.

In one preferred arrangement, the metallic radiators are the roof support pillars, such as the A-pillars, or C- or D-pillars, of the vehicle unibody.

Thus a vehicle structure includes an electrically conductive roof section supporter by four electrically conductive roof pillars that define a vehicle passenger compartment. Meanderlines are connected to each of a corresponding one of the conductive roof pillars; four phase shifters, are also each connected to a corresponding second terminal of one of the meanderline components. A combining circuit is connected to the phase shifters, to result in the passenger compartment operating as a volumetric, directional antenna array.

BRIEF DESCRIPTION OF THE DRAWINGS

The description below refers to the accompanying drawings, of which.

DETAILED DESCRIPTION OF AN ILLUSTRATIVE EMBODIMENT

Figure 1:
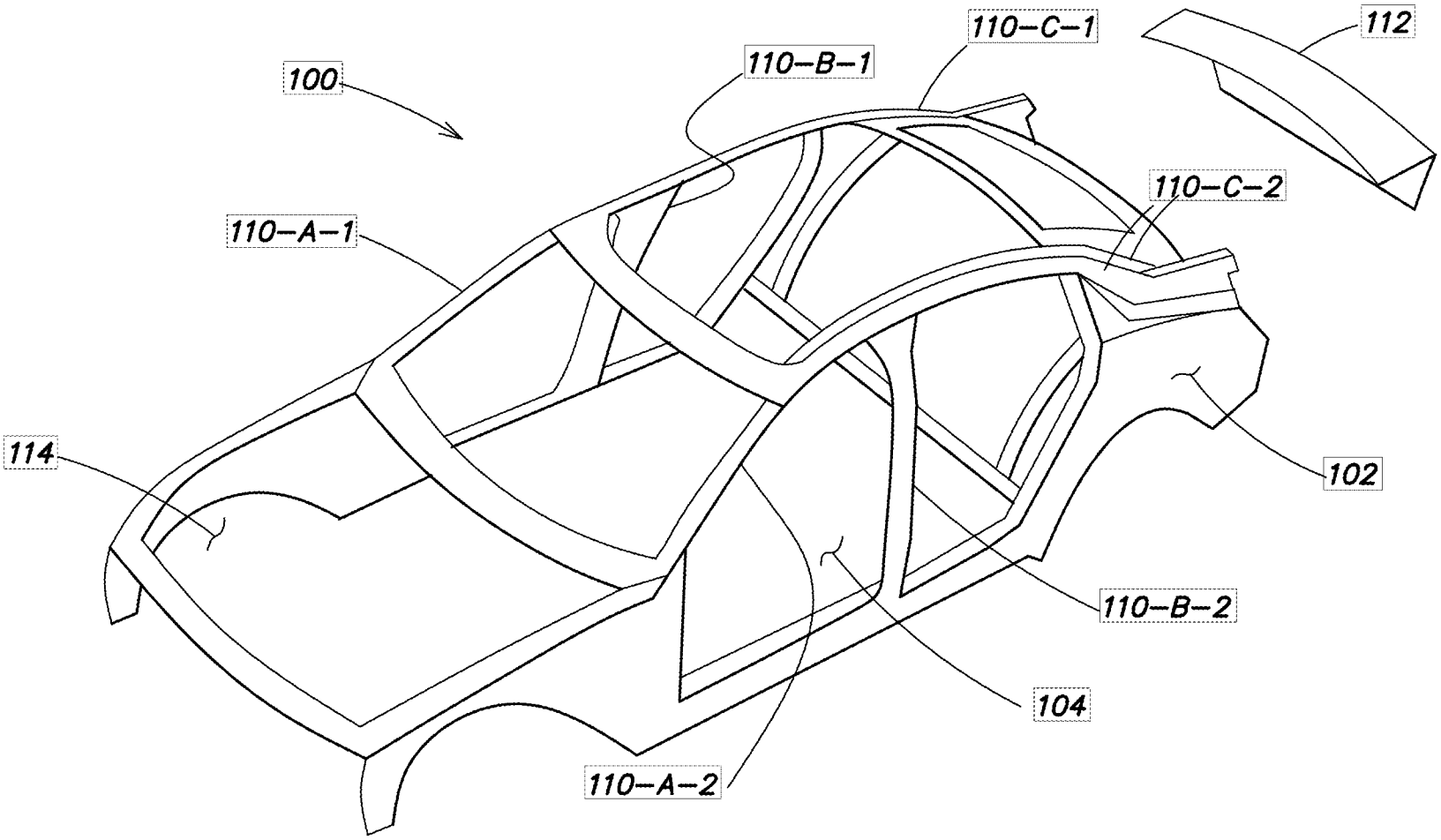
FIG. 1 depicts a unibody structure of a vehicle and its various structure components including a roof and roof support pillars.

FIG. 1 shows the internal "main-body-in-white" structure 100 of a typical automobile. In this example the main body of the vehicle, chassis, floor pan, firewall, exterior body panel support members, etc. form a single unitary structure. This unibody structure, fabricated from steel or increasingly now aluminum, is lighter and more rigid than a vehicle constructed from a separate body and frame. It should be understood however that the principles described herein can also be applied to body on frame vehicle architectures as well.

Exterior metallic body panels such as a hood 114, trunk 112, fenders and doors (not shown) are attached or secured with hinges to the unibody 100. Some exterior panels, such as the roof section (not shown in FIG. 1) are often welded to, mechanically fastened or glued, or integrally formed with the unibody. For the illustrated sedan type automobile, four of the roof pillars or supports 110-A-1, 110-A-2, 110-C-1, 110-C-2 extend downward from and support the corners of a roof section. These nearly vertical supports 110 also define the vehicle's passenger compartment (the "cab" or "greenhouse")—and often designated respectively as the A-, B-, C- or (in larger vehicles) D-pillar, as one moves from the front to rear of the vehicle, in profile view.

The A-pillars 110-A are those closest to the hood (front of the car) positioned on either side of the windshield; B-pillars 110-B, sometimes referred to as the center posts, are generally in the center of the vehicle; and the C-pillars 110-C are those towards the rear of the passenger compartment. For a sedan or coupe body style, the C-pillars define an opening for and are positioned on either side of the rear window. Larger vehicles, such a Sport Utility Vehicle (SUV) or station wagon, may have a fourth generally vertical support referred to the D-pillar, near the very back of the vehicle.

Figure 2:
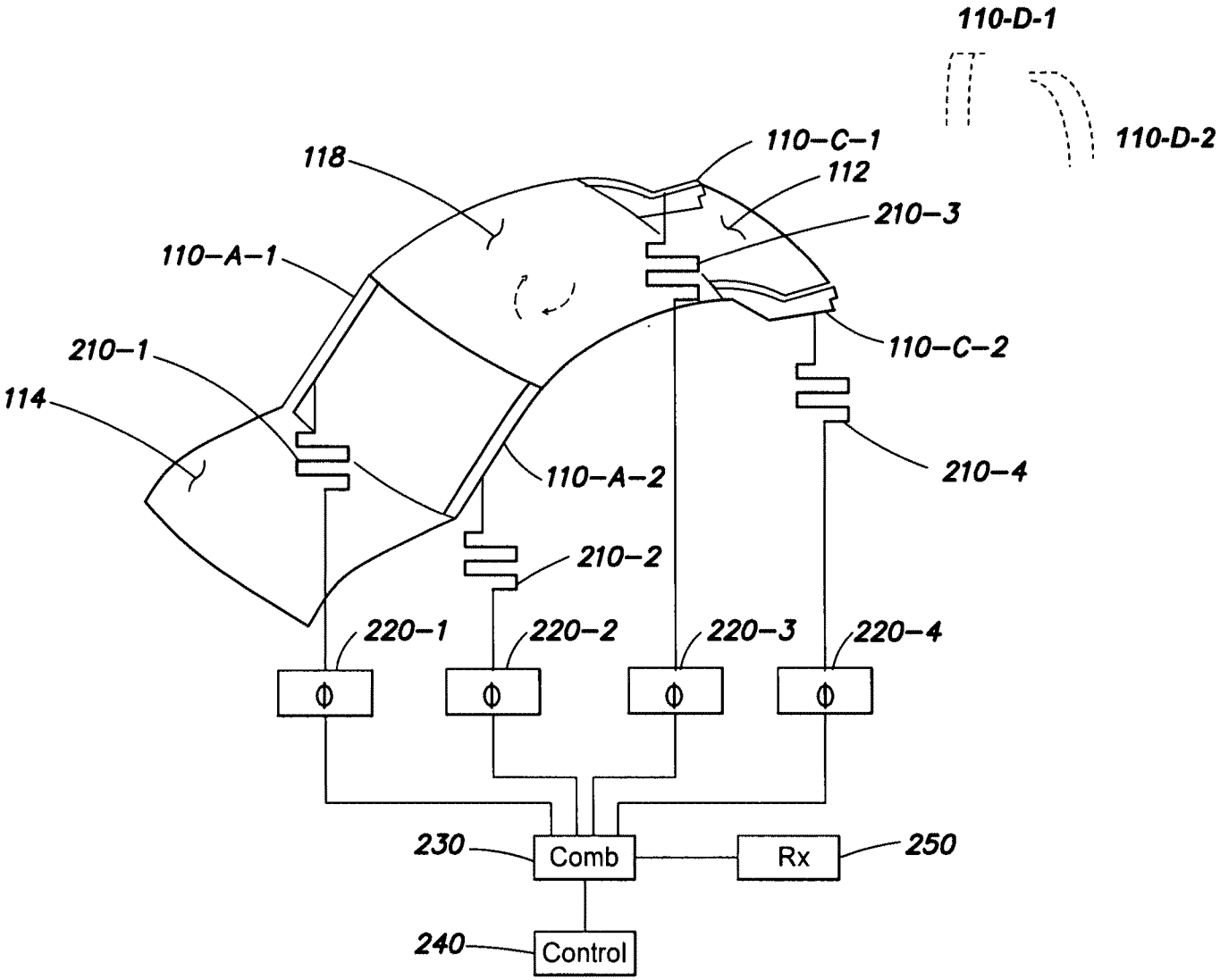
FIG. 2 is an arrangement where four support pillars become the radiating elements of an antenna array suitable.

FIG. 2 shows more detail of an arrangement where the four support pillars 110 become the elements 110 of an antenna array suitable for operating in the AM and FM broadcast bands. In this example, the four pillars are the two A-pillars 110-A-1, 110-A-2 and the two C-pillars, 110-C-1, 110-C-2. In the case of a different type of vehicle (not shown in FIG. 1 or 2), such as a station wagon or SUV, the four antenna elements may be provided by the two A-pillars and the two D-Pillars 110-D-1, 110-D-2.

Each of four pillars 110-A-1, 110-A-2, 110-B-1, 110-B-2 is used as a radiating element 110 and electrically connected or coupled to one end of a corresponding meanderline component 210-1, 210-2, 210-3, 210-4. The other end of each meanderline 210 is in turn coupled to a radio receiver 250 (or transmitter), typically through some sort of combining network 230. The meanderlines 210 allow tuning of the radiating elements 110 for improved operation in the AM or FM bands.

Corresponding phase shifters and/or delay elements 220-1, 220-2, 220-3, 220-4 may be disposed between each radiating element 110 and a corresponding one of the combiners 230. Switches (not shown in FIG. 2) may also be included to enable or disable the connection between a respective element 110 and the phase shifters/delays 220. While these are optional, if they are included, they permit operating the elements 110 as a beamforming array.

A controller 240 controls the operating states of the combining network 230 and phase shifters/delays 220 and any switches. The controller 240 may be a logic circuit, field programmable gate array, or programmed microprocessor.

The four pillars 110 provide a vertically polarized, 4 element, square configuration. For operation in the FM band (from about 88 to 108 MHz), the spacing between elements is about one-half (½) wavelength.

In one implementation, eight (8) directional beams can be individually generated by combining the outputs of the meanderlines using a combining circuit 230 that includes an array of switches that selectively connects or shorts out each element 110 (not illustrated here). More particularly, combinations of selected ones of the four groups of arrays may be used to generate antenna beams in different directions. One arrangement connects the elements as a pair of crossed dipoles. However, other directional and polarization arrangements are possible.

In one example implementation, the combining circuit 230 may use techniques described in our co-pending U.S. patent application entitled "Super Directive Array of Volumetric Antenna Elements for Wireless Device Applications" Ser. No. 15/362,988 filed Nov. 29, 2016 incorporated by reference herein.

For operation in the AM band, from about 540 kHz to 1600 kHz, the combining network 230 may operate the four elements in a super-directive mode, as also described in the above-referenced co-pending patent application. In one such implementation, only one of the radiating elements is actively driven, and the other three elements are parasitic.

The metal pillars 110 may be mechanically connected to the hood 114 and trunk 112 sections and well as the roof 118 section—indeed, the pillars 110 may often be integrally formed with, fastened to, or welded to the roof 118 or other body components. Even though this means the pillars may be electrically shorted to the roof 118, hood 114, and/or trunk 112, this does not appreciably interfere with operation of the array. This is because the currents exciting the generally planar surfaces of the roof 118, hood 114 and trunk 112 will not be vertically polarized.

Although only three meander sections are suggested for each meanderline 220 in FIG. 2, the actual number used will depend upon the desired electrical length for the particular application. The meanderlines 220 may be constructed in accordance with a number of known techniques. Generally speaking, a meanderline 220 includes a conductor having a series of connected parallel sections following a serpentine path. The meanderline may be fabricated simple as a conductive circuit trace deposited on a printed circuit board or other dielectric substrate.

Figure 3A:
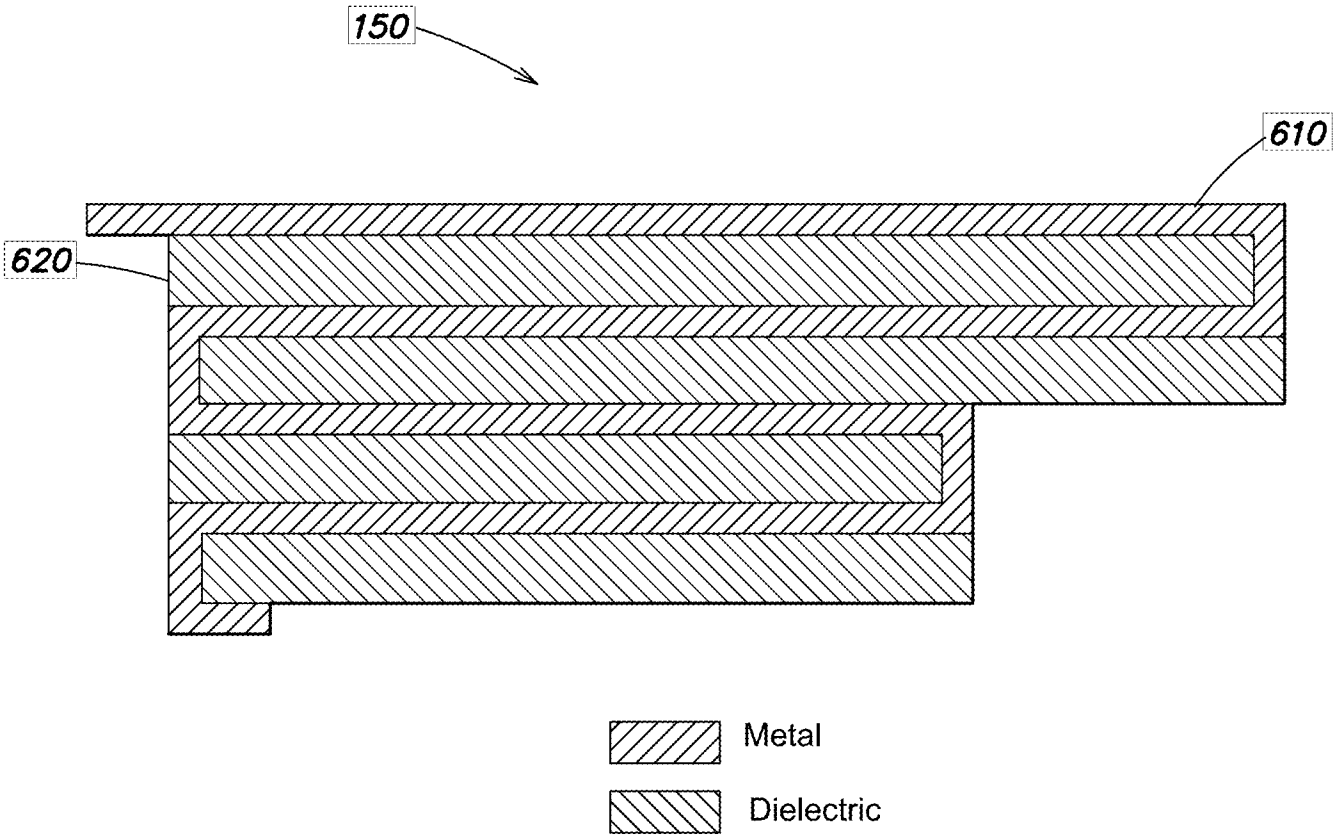
FIGS. 3A and 3B show example meander lines in more detail connecting a side and front patch.
Figure 3B:
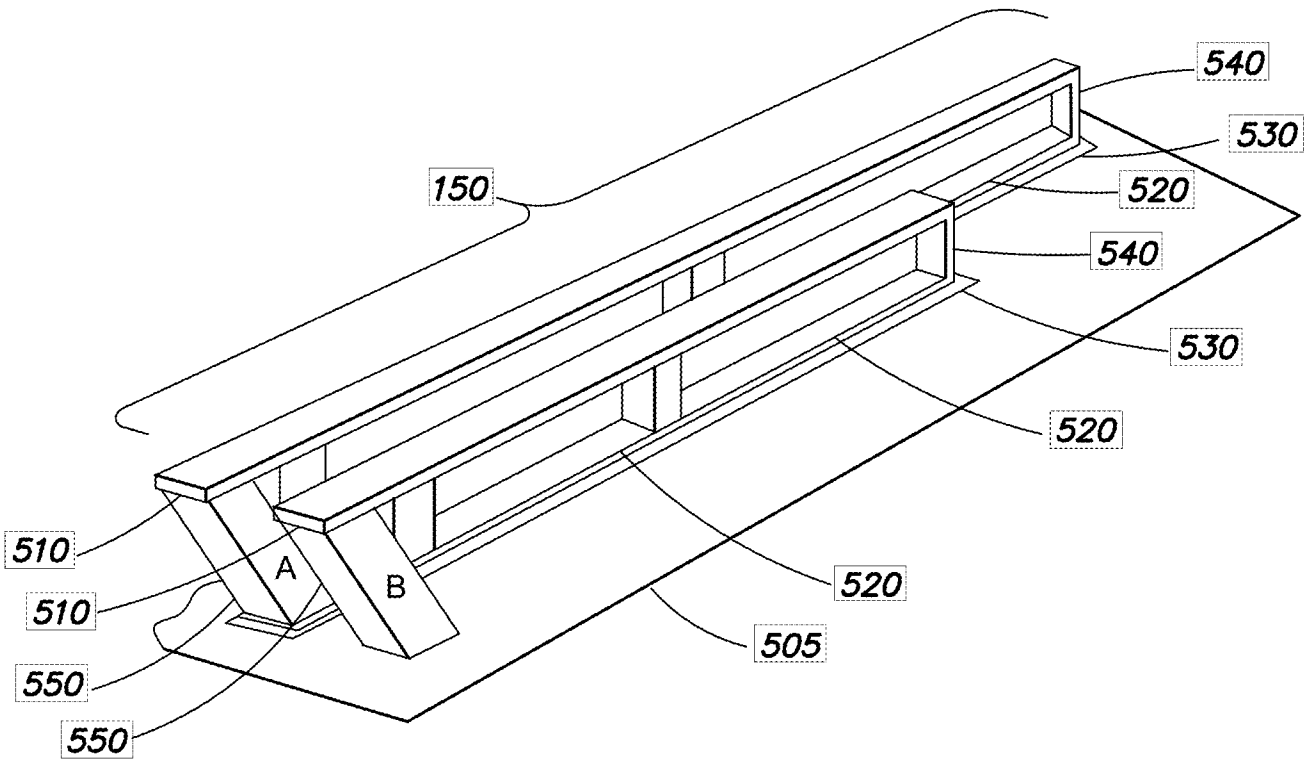

In one example implementation, shown in FIG. 3A, a meanderline 150 may include two or more adjacent planar material layers having alternating conductive 610 and dielectric 620 layer properties. The conductive layers are electrically connected through or around the dielectric layers. The different layers may also provide different impedance values. Still other meanderline 150 implementations, such as that shown in FIG. 3B, may place a serpentine metallic conductors 510, 520, 540, 550 on supports 530 above a plane such as a ground plane 505. The impedance represented by the meanderline may or may not be adjustable, such as by having the controller 240 switch in or out different conductive sections.

The operating frequency of the array is tunable by choosing and/or providing adjustments to the physical characteristics of one or more of the meanderline elements 220, such as by selecting the length thereof, to, for example, achieve resonance in the desired operating band. The shape and dimensions of the meanderline elements 220 can also be varied to effect a change in the performance characteristics, including the operating frequency, of the antenna array.

In alternate embodiment, rather than use the structural support pillars 110 themselves as the radiating elements, a vertically oriented wire conductor may be disposed along, within, or near each vertical support pillar, with the wire conductor electrically isolated from the rest of the body. In another embodiment, a conductor may be disposed within weather stripping that is placed between or adjacent each support pillar and the sides of the windshield or rear window.

Figure 4:
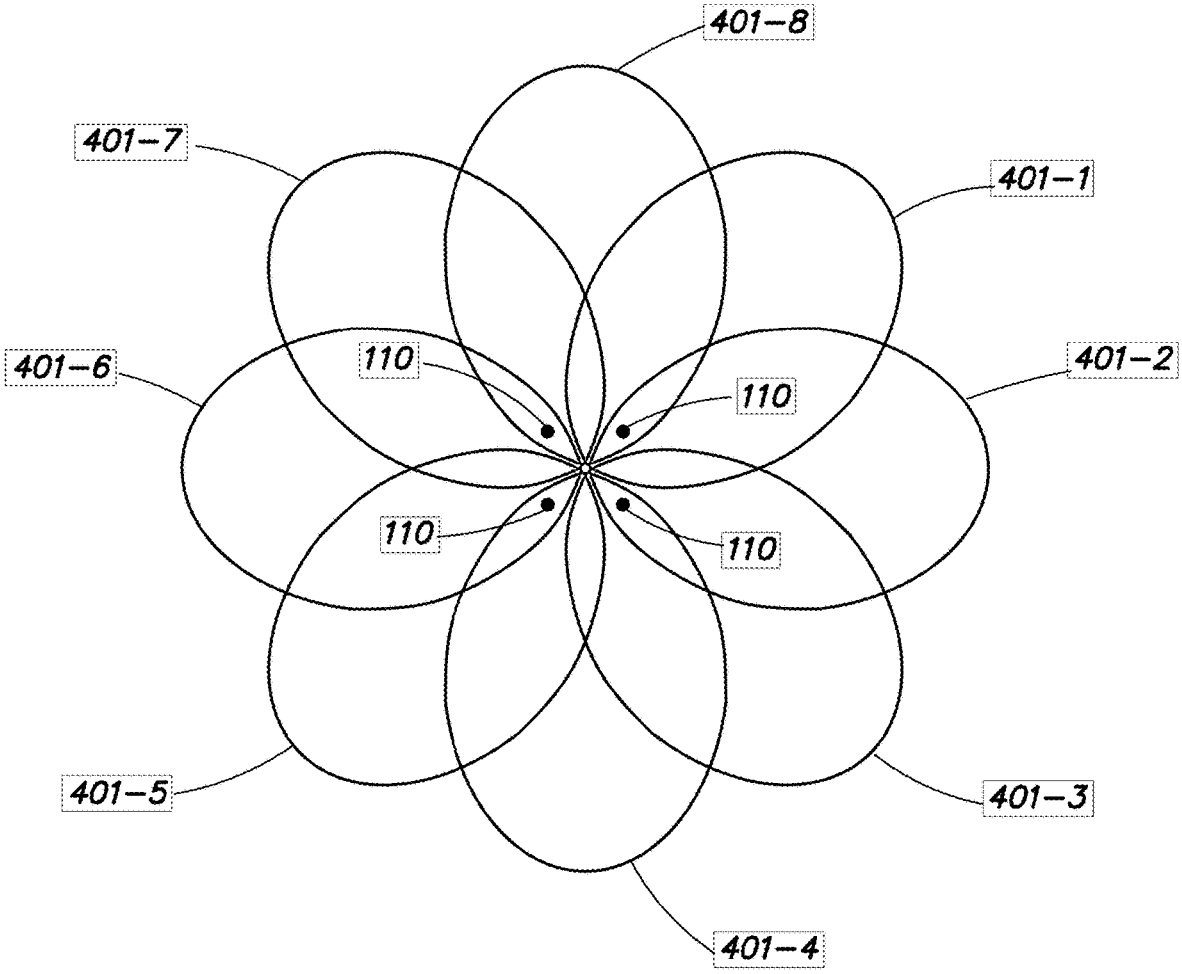
FIG. 4 illustrates typical directional beam patterns for the antenna system of FIG. 2.

FIG. 4 is an example of typical beam patterns that can be achieved with the array of FIG. 2. The four array elements 110 are generally illustrated in a square; the resulting eight beams 401-1, . . . , 401-8 are shown. Gains and/or directivities are expected to approach about 6 dBi.

Figure 5A:
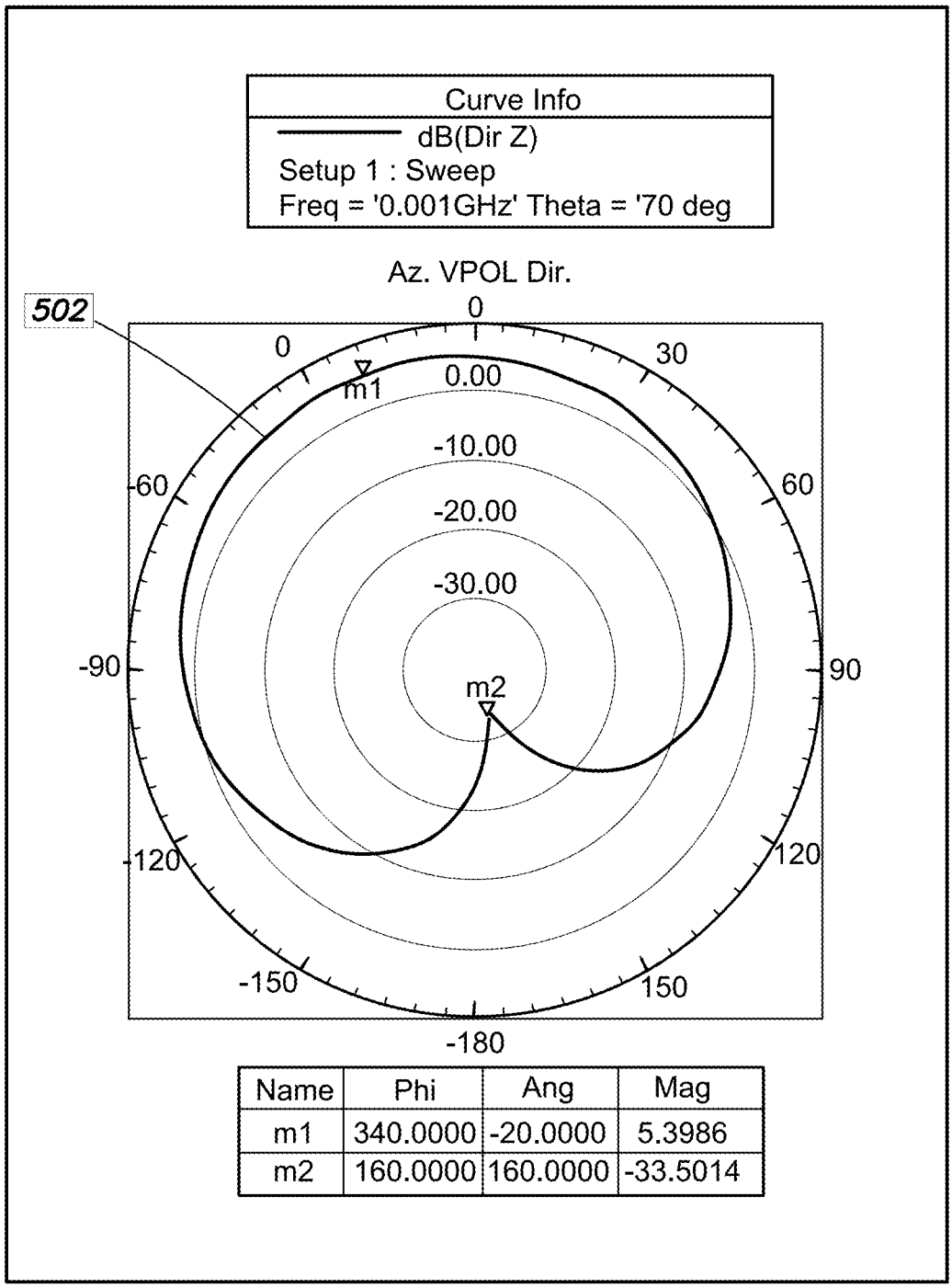
FIGS. 5A and 5B show the result of a simulation of the antenna system.
Figure 5B:
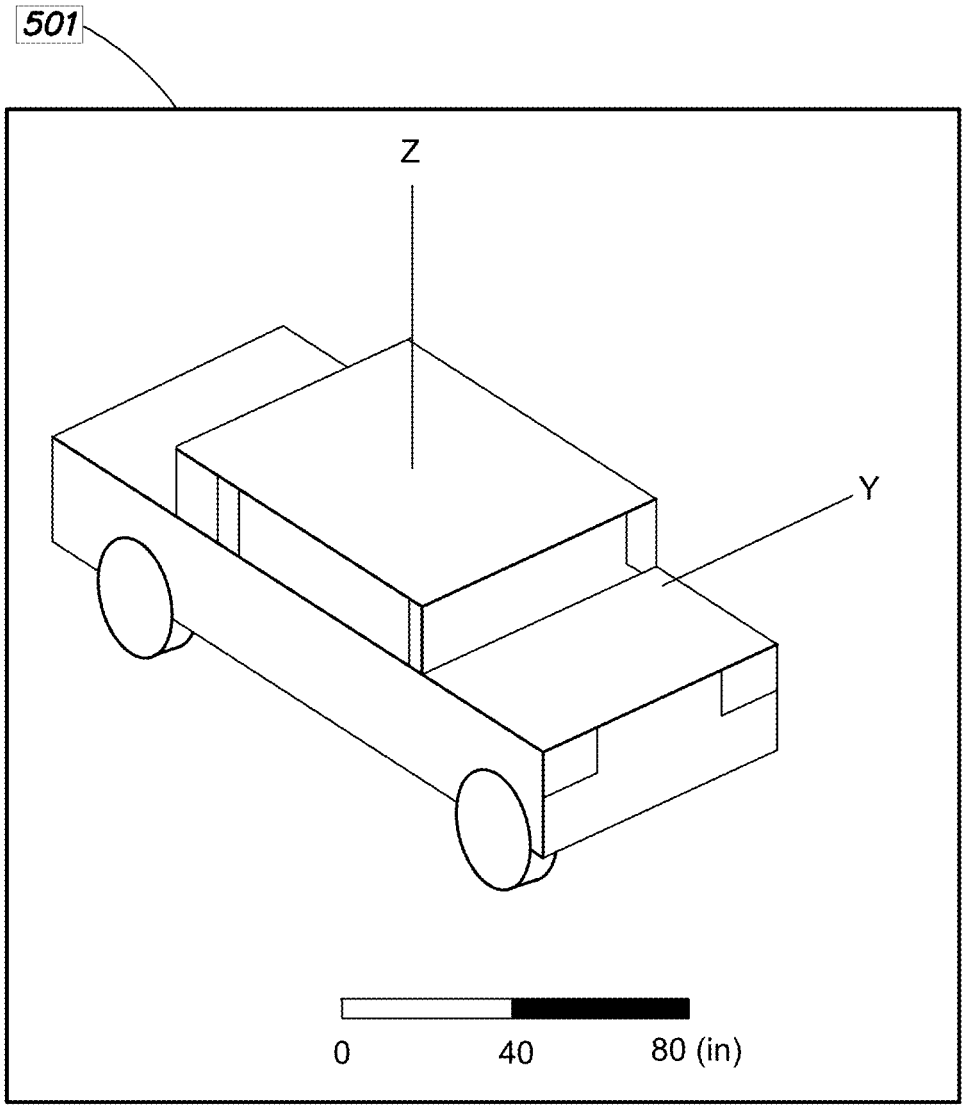

Indeed, estimate of the antenna pattern was made from a model of the array was implemented with the High Frequency Simulation System (HFSS) engineering simulation software available from ANSYS of Canonsburg, Pa. The vehicle was modeled 501 as shown in FIG. 5B as a metallic roof section and four vertical metallic supports, with the A-pillars in the left and right corners of the front of the roof section and the C-pillars slightly inset from the rear corners. The other parts of the vehicle were not modeled. The structure was excited via connections made at the bottom of the pillars at a frequency of 0.001 GHz. The resulting antenna pattern 502, shown in FIG. 5A, is a gain of +5 dBi (measurement point m1) with significant nulls of about 30 dB (measurement point m2).

Arranging the conductive roof and four side pillars together with the combining circuit, in effect turns the cab into a volumetric directional antenna.

What is claimed is:

1. An antenna system for use in a vehicle, comprising:

four metallic radiating roof pillars, extending downward from a metallic roof section of the vehicle, the metallic radiating roof pillars each comprising a radiating antenna element;

four meanderline components, each having a first and second terminal, with the first terminal connected to a corresponding one of the metallic radiating roof pillars, each meanderline component further including two or more adjacent planar material layers having alternating conductive and dielectric layer properties, with the conductive layers electrically connected through or around the corresponding adjacent dielectric layers, each meanderline component having an impedance value that depends on an operating frequency;

a combining circuit, connected to the second terminal of each of the meanderline components; and a radio, connected to the combining circuit.

2. The antenna system of claim 1 additionally comprising: four phase shifters, connected between corresponding ones of the meanderline components and the combining circuit.

3. The antenna system of claim 1 wherein the four metallic radiating roof pillars are metallic roof support pillars including include two A-pillars and two C- or D-pillars.

4. The antenna system of claim 1 wherein the four metallic radiating roof pillars include two A-pillars and two C-pillars.

5. The antenna system of claim 1 wherein the four metallic radiating roof pillars are disposed adjacent four corners of the metallic roof section, to further provide a volumetric directional antenna array.

6. The antenna system of claim 1 wherein the meanderline components further comprise a set of parallel conductive sections.

7. The antenna system of claim 6 wherein the impedance of the meanderline components is further selected to tune the radiating elements for operation in a selected radio frequency band.

8. The antenna system of claim 2 wherein the combining circuit further enables or disables the connection between a respective meanderline component and a respective one of the metallic radiating roof pillars.

9. The antenna system of claim 1 wherein one or more of the metallic radiating support roof pillars are electrically shorted to the metallic roof section.

10. The antenna system of claim 9 wherein one or more of the metallic radiating roof pillars further induce currents on a planar surface of the metallic roof section.

11. The antenna system of claim 1 additionally comprising:

a controller, coupled to the meanderlines, for adjusting the impedance values of the meanderlines.

* * * * *